US007682558B2

(12) United States Patent
Knutsson et al.

(10) Patent No.: US 7,682,558 B2
(45) Date of Patent: Mar. 23, 2010

(54) METALLURGICAL POWDER COMPOSITION

(75) Inventors: Per Knutsson, Ångelholm (SE); Per-Olof Larsson, Helsingborg (SE); Hilmar Vidarsson, Munka-Ljungby (SE)

(73) Assignee: Höganäs AB (PUBL), Höganäs (SE)

( * ) Notice: Subject to any disclaimer, the term of this patent is extended or adjusted under 35 U.S.C. 154(b) by 0 days.

(21) Appl. No.: 12/085,599

(22) PCT Filed: Dec. 20, 2006

(86) PCT No.: PCT/SE2006/001443

§ 371 (c)(1),
(2), (4) Date: Jul. 23, 2008

(87) PCT Pub. No.: WO2007/078232

PCT Pub. Date: Jul. 12, 2007

(65) Prior Publication Data

US 2008/0302209 A1 Dec. 11, 2008

Related U.S. Application Data

(60) Provisional application No. 60/755,006, filed on Dec. 30, 2005.

(30) Foreign Application Priority Data

Dec. 30, 2005 (SE) ..... 0502933

(51) Int. Cl.
*B22F 1/02* (2006.01)
*B22F 3/00* (2006.01)

(52) U.S. Cl. ..... 419/37; 75/252; 419/65

(58) Field of Classification Search ..... 75/252; 419/36, 65, 66, 37
See application file for complete search history.

(56) References Cited

U.S. PATENT DOCUMENTS

| | | | | |
|---|---|---|---|---|
| 3,340,024 | A * | 9/1967 | Mahar | 75/316 |
| 3,357,818 | A | 12/1967 | Findeisen et al. | |
| 3,539,472 | A | 11/1970 | Findeisen et al. | |
| 3,728,110 | A * | 4/1973 | Klar et al. | 419/36 |
| 4,483,905 | A | 11/1984 | Engstrom | |
| 4,676,831 | A | 6/1987 | Engstrom | |
| 4,834,800 | A | 5/1989 | Semel | |
| 5,258,151 | A | 11/1993 | Bayer et al. | |
| 5,290,336 | A | 3/1994 | Luk | |
| 5,298,055 | A | 3/1994 | Semel et al. | |
| 5,368,630 | A | 11/1994 | Luk | |
| 5,480,469 | A | 1/1996 | Storstrom et al. | |
| 5,782,954 | A | 7/1998 | Luk | |
| 2006/0000310 | A1 | 1/2006 | Solimnjad | |

FOREIGN PATENT DOCUMENTS

| | | |
|---|---|---|
| DE | 4136615 A1 | 5/1993 |
| JP | 06-145701 | 5/1994 |
| WO | WO2005061157 A1 | 7/2005 |

* cited by examiner

*Primary Examiner*—Roy King
*Assistant Examiner*—Ngoclan T Mai
(74) *Attorney, Agent, or Firm*—Buchanan Ingersoll & Rooney PC

(57) ABSTRACT

A metallurgical composition is provided for making compacted parts, comprising: (a) at least about 80 percent by weight of an iron or iron-based powder; (b) up to about 20 percent by weight of at least one alloying powder; (c) from about 0.05 to about 2 percent by weight of a binding agent comprising a $C_{14}$-$C_{30}$ fatty alcohol; and (d) from about 0.001 to about 0.2 percent by weight of a flow agent.

12 Claims, 1 Drawing Sheet

METALLURGICAL POWDER COMPOSITION

This is a 35 U.S.C. §371 filing of International Patent Application No. PCT/SE2006/001443, filed Dec. 20, 2006. The benefit is claimed under 35 U.S.C. §119(a)-(d) of Swedish Application No. 0502933-5, filed Dec. 30, 2005, and under 35 U.S.C. §119(e) of U.S. Provisional Application No. 60/755,006, filed Dec. 30, 2005.

FIELD OF THE INVENTION

The present invention relates to a new metal powder composition for the powder metallurgical industry. Particularly the invention relates to an iron-based powder composition which includes a binder for binding additives, such as alloying elements, to the iron-based particles.

BACKGROUND OF THE INVENTION

In industry the use of metal products manufactured by compacting and sintering iron-based powder compositions is becoming increasingly widespread. The quality requirements of these metal products are continuously raised, and as a consequence new powder compositions having improved properties are developed. One of the most important properties of the final, sintered products is the density and dimensional tolerances, which have to be consistent. Problems with size variations in the final product often originates from inhomogenities in the powder mixture to be compacted. These problems are especially pronounced with powder mixtures including pulverulent components, which differ in size, density and shape, a reason why segregation occurs during the transport, storage and handling of the powder composition. This segregation implies that the composition is non-uniformly composed, which in turn means that parts made of the powder composition are differently composed and consequently have different properties. A further problem is that fine particles, particularly those of lower density such as graphite, cause dusting during the handling of the powder mixture.

The small particle size of additives also create problems with the flow properties of the powder, i.e. the capacity of the powder to behave as a free-flowing powder. An impaired flow manifests itself in increased time for filling a die cavity with powder, which means lower productivity and an increased risk of variations in density in the compacted component, which may lead to unacceptable deformations after sintering. Further, in order to eject the compacted component from the die, minimize the wear of the die surface and to obtain parts having good surface finish without scratches it is essential that the force required to eject the component from the die is low.

Attempts have been made at solving the problems described above by adding different binding agents and lubricants to the powder composition. The purpose of the binder is to bind firmly and effectively the small size particles of additives, such as alloying components, to the surface of the base metal particles and, consequently, reduce the problems of segregation and dusting. The purpose of the lubricant is to reduce the internal and external friction during compaction of the powder composition and above all to reduce the force required to eject the finally compacted product from the die.

Various organic binding agents have been developed see e.g. U.S. Pat. Nos. 4,483,905 (Engstrom), 4,676,831 (Engstrom) 4,834,800 (Semel), 5,298,055 (Semel), 5,290,336 (Luk), 5,368,630 (Luk). The U.S. Pat. No. 5,480,469 (Storstrom) provides a brief review of the use of binding agents in the powder metallurgy industry.

In the recently published patent publication WO 2005/061157 a binding/lubricating combination of polyethylene wax and ethylene bisstearamide is disclosed. In the powder composition used for compaction, the polyethylene wax is present as a layer or coating on the iron or iron-based particles and binds the alloying element particles and the ethylene bisstearamide particles to the iron or iron-based particles. It is preferred that the composition also includes a fatty acid and a flow agent. A good combination of AD, flow, bonding and lubrication properties for the powder metallurgical composition, containing a binding/lubricating combination including the polyethylene wax and ethylene bisstearamide is achieved when the mean molecular weight of the polyethylene wax is between 500 and 750.

It has now been found that iron-based compositions having remarkably improved apparent density and also improved flow, can be obtained if fatty alcohols are used instead of polyethylene wax. All in all it has been found that fatty alcohols in combination with flow agents give interesting results as regards apparent density and flow. The apparent density is essential for the tool design. A powder with low apparent density needs higher filling height which results in unnecessarily high pressing tools, and this in turn will result in longer compaction and ejection strokes. As previously mentioned the flow is important for the productivity. It has also unexpectedly been found that when the new powder metal compositions, which include fatty alcohols as a binder and a flow agent, are compacted, the obtained green compacts have excellent weight stability, i.e. low weight scatter within a set of green compacts. This property is naturally of outmost importance for the production of high performance product.

Fatty alcohols have been mentioned in the patent literature in connection with lubrication in the U.S. Pat. No. 3,539,472. Specifically this patent teaches that small amounts of fatty alcohols can be included in lubricants mainly consisting of amides or diamides. The patent does not concern bonded mixtures.

Also the Japanese patent application 04-294 782, publication number 06-145701 mentions that fatty alcohols can be used as lubricants. Specifically mentioned are C30 alcohols, C50 alcohols and C60 alcohols. The application text also mentions higher fatty alcohols as binders.

SUMMARY OF THE INVENTION

The present invention thus concerns a new metallurgical powder composition comprising an iron or iron-based powder, at least one alloying agent, and a fatty alcohol as a binder. In order to perform satisfactorily the fatty alcohol should be a saturated or unsaturated, straight chained or branched, preferably saturated and straight chained, $C_{14}$-$C_{30}$ fatty alcohol. The new powder composition should also include a flow agent. The present invention also relates to a method of manufacturing the above composition.

DETAILED DESCRIPTION OF THE INVENTION

The powder metallurgical compositions contain an iron or iron-based powder in an amount of at least 80% by weight of the powder metallurgical composition. The iron-based powder may be any type of iron-based powder such as a water-atomised iron powder, reduced iron powder, pre-alloyed iron-based powder or diffusion alloyed iron-based powder. Such powders are e.g. the iron powder ASC100.29, the diffusion alloyed iron-based powder Distaloy AB containing Cu, Ni and Mo, the iron-based powder Astaloy CrM and Astaloy CrL pre-alloyed with Cr and Mo, all available from Höganäs AB, Sweden.

The particles of the iron or iron-based powder normally have a weight average particle size up to about 500 microns; more preferably the particles will have a weight average particle size in the range of about 25-150 microns, and most preferably 40-100 microns.

Examples of alloying elements which are bonded to the iron or iron-based particles may be selected from the group consisting of graphite, Cu, Ni, Cr, Mn, Si, V, Mo, P, W, S and Nb. These additives are generally powders having a smaller particle size than the base iron powder, and most alloying elements have a particle size smaller than about 20 μm. The amount of the alloying elements in the powder metallurgical compositions depends on the specific alloying element and the desired final properties of the sintered component. Generally it may be up to 20% by weight. Other pulverulent additives which may be present are hard phase materials, liquid phase forming materials and machinability enhancing agents.

Fatty alcohols used for binding the alloying elements and/or optional additives are preferably saturated, straight chained and contain 14 to 30 carbon atoms as they have an advantageous melting point for the melt-bonding technique used for binding the alloying elements and/or other optional additives. The fatty alcohols are preferably selected from the group consisting of cetyl alcohol, stearyl alcohol, arachidyl alcohol, behenyl alcohol and lignoceryl alcohol, and most preferably selected from the group consisting of stearyl alcohol, arachidyl alcohol and behenyl alcohol. The amount of fatty alcohol used may be between 0.05 and 2, preferably between 0.1 and 1 and most preferably between 0.1 and 0.8, % by weight of the metallurgical composition. Also combinations of fatty alcohols may be used as binder.

In order to impart satisfactory flow to the new powder compositions flow agents are added. Such agents are previously known from e.g. the U.S. Pat. No. 3,357,818 and U.S. Pat. No. 5,782,954 which discloses that metal, metal oxides or silicon oxide can be used as flow agent.

Especially good results have been obtained when carbon black is used as flow agent. The use of carbon black as flow agent is disclosed in the co-pending Swedish patent application 0401778-6 which is hereby incorporated by reference. It has been found that the amount of carbon black should be between 0.001 and 0.2% by weight, preferably between 0.01 and 0.1%. Furthermore it has been found that the primary particle size of the carbon black preferably should be below 200 nm, more preferably below 100 nm and most preferably below 50 nm. According to a preferred embodiment the specific surface area should be between 150 and 1000 $m^2/g$ as measured by the BET-method.

In order to enhance the compressibility of the powder, and to facilitate ejection of the green component, an organic lubricant or a combination of different organic lubricants may be added to the powder metallurgical composition. The lubricant may be present as a free particulate powder or bonded to the surface of the iron-based powder.

Although the fatty alcohol which is used as a binder also has lubricating properties it may be convenient to use an additional lubricant. The type of solid organic lubricant of the invention is not critical, but due to the disadvantages with metal organic lubricants (generating residues of metal oxides during sintering), the organic lubricant does preferably not include metal. Zinc stearate is a commonly used lubricant giving good flow properties and high AD. However besides generating residues of zinc oxide during sintering another drawback is that the material may generate stains on the surfaces of the sintered components. Thus the organic lubricant may be selected from a wide variety of organic substances having lubricating properties. Examples of such substances are fatty acids, waxes, polymers, or derivates and mixtures thereof. Preferred lubricants are primary amides, such as stearic amide, arachidic amide and behenic amide, secondary amides, such as stearylstearic amide, and bisamides, such as ethylene bis-stearamide.

As regards the amounts it has been found that the amount of fatty alcohol should be from 10 to 90% by weight of the combined binder, flow agent and lubricant weights. The total amount of binder, flow agent and, optionally, lubricant, may vary from 0.1 to 2% by weight of the powder metallurgical composition.

Figure 1:
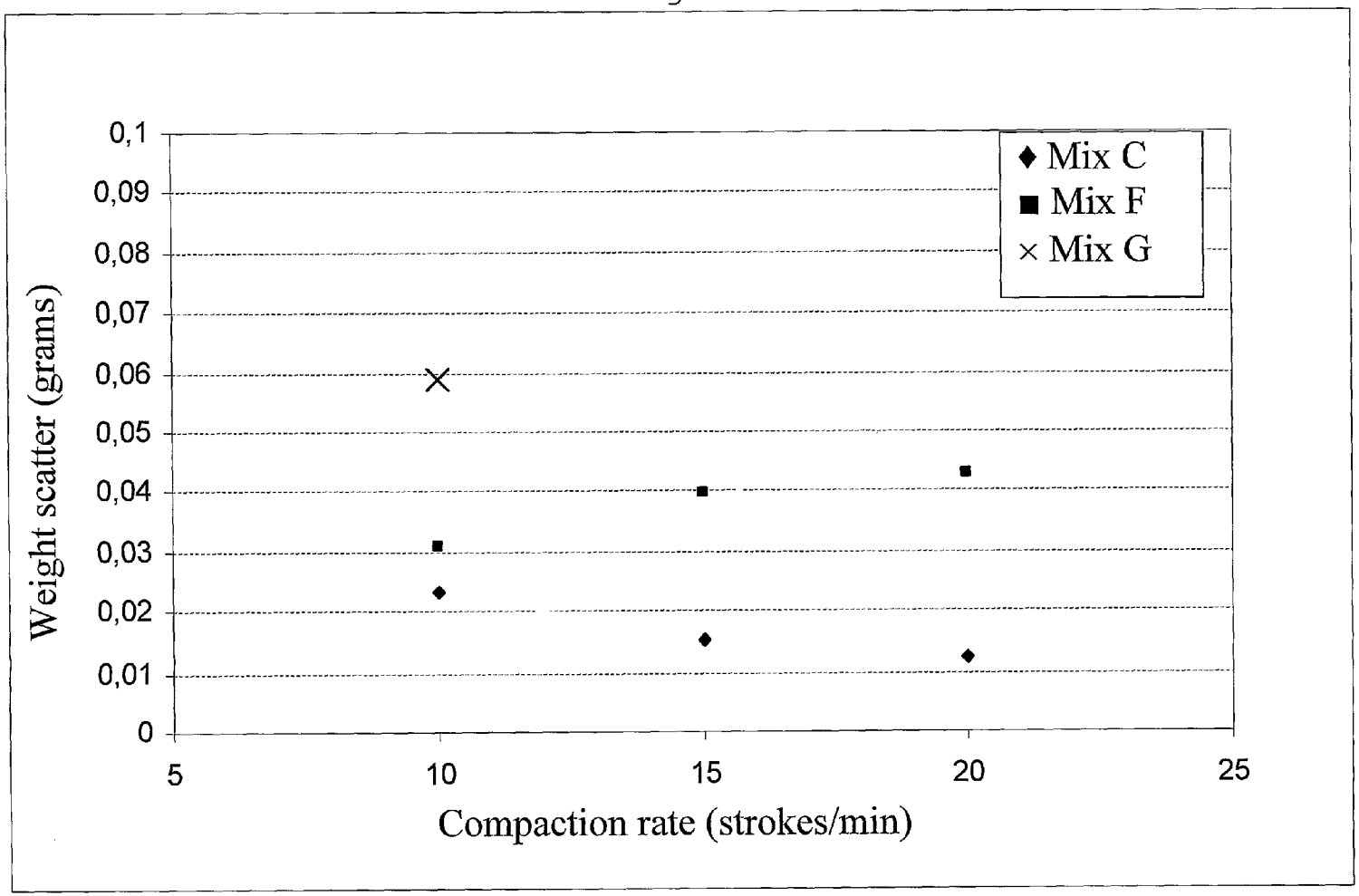
FIG. 1 is a diagram displaying the difference in weight scatter at different production rates when using a powder metallurgical composition according to the invention as compared with conventional powder metallurgical compositions.

The invention is further illustrated by the following non limiting examples.

EXAMPLE 1

Different iron-based powder metallurgical mixtures, according to table 1, were prepared. As iron-based powder the water-atomised iron powder ASC100.29 available from Höganäs AB, Sweden, was used. Apart from the binders, lubricants and flow agents according to table 1, 2% by weight of the total iron-based mixture, of copper powder, 100 mesh, available from Makin Metal Powder Ltd., and 0.8%, by weight of the total iron based mixture, of graphite, UF 4 (available from Graphit Kropfmühl AG, Germany) were added.

Ethylene bisstearamide (EBS) was available as Licowax™ from Clariant (Germany) and silicon dioxide was available as Aerosil from Degussa AG (Germany). Behenyl alcohol, stearyl alcohol and cetyl alcohol was available from Sasol Germany GmbH and carbon black was available from Degussa AG.

In mix A-C & H-I, 0.6%, by weight of the total iron-based powder mix, of a lubricant (called "C18-C22 primary amide" below) essentially consisting of a technical grade of strait-chained saturated primary amides having chain lengths of 18, 20 and 22 carbon atoms, thus containing stearic amide (about 40%), arachidic amide (about 40%), and behenic amide (about 20%), was used. As a lubricant in mix D-F, 0.6% of ethylene bis-stearamide (EBS) and in mix G 0.8 of ethylene bis-stearamide (EBS) was used. In mix A-E & H-J, 0.2%, by weight of the total iron-based powder mix, of fatty alcohol was used (in H a mix of two fatty alcohols were used), and in mix F, 0.2%, by weight of the total iron-based powder mix, of a polyethylene wax having a molecular weight of 655 (a binder according to WO 2005/061157) was used.

The components in mix A-F & H-J were thoroughly mixed, and during the mixing the temperature was raised to above the melting point of the binder, for mix A-E & H-J to 75° C. and for mix F to 105° C. During the subsequent cooling, the finer particles of the mix were bonded to the surface of the larger particles of the iron-based powder by the solidifying binder. In case a flow agent was used, it was added after solidification of the binder during the cooling of the mix. The components of mix G were blended without any heating as this mix was not bonded.

TABLE 1

Iron-based powder metallurgical mixtures prepared

| Mix | Binder | Lubricant | Flow agent | |
|---|---|---|---|---|
| A | Behenyl alcohol | C18-C22 primary amide | — | comparative example |
| B | Behenyl alcohol | C18-C22 primary amide | Silcon dioxide | example according to the invention |
| C | Behenyl alcohol | C18-C22 primary amide | carbon black | example according to the invention |
| D | Behenyl alcohol | EBS | — | comparative example |
| E | Behenyl alcohol | EBS | carbon black | example according to the invention |
| F | PE 655 | EBS | Silcon dioxide | comparative example |
| G (premix) | — | EBS | — | comparative example |
| H | Mix of Stearyl and Behenyl alcohol 25%/75% | C18-C22 primary amide | carbon black | example according to the invention |
| I | Cetyl alcohol | C18-C22 primary amide | carbon black | according to the invention example |
| J | Cetyl alcohol | Zinc stearate | carbon black | according to the invention |

The Hall flow rate was measured according to ISO 4490 and the apparent density was measured according to ISO 3923.

TABLE 2

Flow rate and Apparent density of iron-based powder metallurgical mixtures

| Mix | Hall flow [seconds/50 grams] | Apparent Density (AD) [g/cm$^3$] |
|---|---|---|
| A | 29.0 | 3.16 |
| B | 23.2 | 3.22 |
| C | 23.8 | 3.32 |
| D | 29.6 | 3.08 |
| E | 27.1 | 3.20 |
| F | 25.5 | 3.06 |
| G (premix) | 33.0 | 3.03 |
| H | 24.1 | 3.27 |
| I | 24.2 | 3.25 |
| J | 23.7 | 3.26 |

Table 2 shows that besides good flow rates, a substantial increase of the AD are obtained when using iron-based powder compositions according to the invention.

For mixture C, D, G, H, I and J the lubricating properties were also measured, by recording the total energy per enveloped area needed in order to eject a compacted sample from the die as well as the peak ejection force per enveloped area. The components were ring shaped having an outer diameter of 55 mm, an inner diameter of 45 mm and a height of 15 mm, and the compaction pressures applied were 400, 500, 600 and 800 MPa.

TABLE 3

Peak ejection force and ejection energy

| | Peak ejection force [N/mm$^2$] | | | | Ejection energy [J/cm$^2$] | | | |
|---|---|---|---|---|---|---|---|---|
| Mix | 400 Mpa | 500 MPa | 600 MPa | 800 MPa | 400 MPa | 500 MPa | 600 MPa | 800 MPa |
| C | 24.3 | 29.3 | 31.7 | 35.2 | 26.4 | 32.9 | 37.0 | 41.5 |
| D | 25.0 | 29.5 | 32.3 | 38.0 | 30.3 | 37.9 | 43.5 | 49.4 |
| G | 22.7 | 28.3 | 32.3 | 36.7 | 32.3 | 40.3 | 46.6 | 52.2 |
| H | 22.4 | 28.9 | 31.8 | 35.0 | 26.0 | 33.2 | 36.5 | 41.1 |
| I | 17.7 | 21.5 | 24.5 | 28.0 | 28.2 | 34.1 | 37.8 | 38.9 |
| J | 20.6 | 25.7 | 30.1 | 36.0 | 34.8 | 43.4 | 48.0 | 51.6 |

Table 3 shows that when using a composition containing cetyl alcohol (16 C) or behenyl alcohol (22 C), or a mixture of stearyl alcohol (18 C) and behenyl alcohol, and the amide mixture (primary fatty amides) as a lubricating/binding combination for production of a compacted component the total energy needed in order to eject the component is substantially reduced.

EXAMPLE 2

The weight stability, i.e. the scatter in weight between the components during a production run, was also recorded when producing components from mix C, F and G. Ring shaped components having an outer diameter of 25 mm, an inner diameter of 19 mm and a height of 15 mm were compacted in a continuous production run at a compaction pressure of 600 MPa, and at three different compaction rates (10, 15 and 20 strokes per minute). 250 components from each mix, and at each production rate, were produced. (For mix G production rates higher than 10 strokes/min were not achievable due to incomplete filling of the tool)

FIG. 1 shows the obtained weight stability at each compaction rate for mix C, F and G expressed as standard deviation for the weights of the components. As can be seen from FIG. 1, a substantial improvement of the weight stability is achieved when producing components from the mix according to the invention (Mix C) compared to producing components from a mix according to WO 2005/061157 (Mix F) and compared to producing components from a non-bonded premix containing the commonly used lubricant ethylene bis-stearamide (Mix G). This is especially pronounced at higher compaction rates.

The invention claimed is:

1. A metallurgical powder composition for making compacted parts, comprising:

(a) at least about 80 percent by weight of an iron or iron-based powder;

(b) up to about 20 percent by weight of at least one alloying powder;

(c) from about 0.05 to less than 2 percent by weight of a binding agent comprising $C_{14}$-$C_{30}$ fatty alcohol;

(d) from about 0.001 to about 0.2 percent by weight of a flow agent, and (e) an organic metal-free pulverulent lubricant selected from the group consisting of stearic amide, arachidic amide, behenic amide, stearylstearic amide, ethylene bis-stearamide, and combinations thereof, wherein the total amount of binding agent (c), flow agent (d), and organic metal-free lubricant (e) is from 0.1 to 2 percent by weight of said metallurgical powder composition, and wherein said binding agent (c) is present in a concentration of 10 to 90 percent by weight based on the total weight of said binding agent (c), said flow agent (d), and said organic metal-free lubricant (e).

2. The powder composition according to claim 1, wherein the fatty alcohol is saturated and straight chained.

3. The powder composition according to claim 1, wherein the fatty alcohol is selected from the group consisting of cetyl alcohol, stearyl alcohol, arachidyl alcohol, behenyl alcohol and lignoceryl alcohol.

4. The powder composition according to claim 1, wherein the fatty alcohol is selected from the group consisting of stearyl alcohol, arachidyl alcohol and behenyl alcohol.

5. The powder composition according to claim 1, wherein the flow agent is chosen from the group consisting of carbon black and silicon dioxide.

6. The powder composition according to claim 1, wherein the flow agent is carbon black.

7. The powder composition according to claim 6, wherein the particle size of the carbon black is below 200 nm.

8. The powder composition to claim 1, wherein the organic metal-free pulverulent lubricant (e) is behenic amide.

9. A method of producing a metallurgical powder composition for making compacted parts, comprising:

providing the following components: (a) at least about 80 percent by weight of an iron or iron-based powder, (b) up to about 20 percent by weight of at least one alloying powder, (c) from about 0.05 to less than 2 percent by weight of a binding agent comprising $C_{14}$-$C_{30}$ fatty alcohol, (d) from about 0.001 to 0.2 percent by weight of a flow agent and (e) an organic metal-free pulverulent lubricant selected from the group consisting of stearic amide, arachidic amide, behenic amide, stearylstearic amide, ethylene bis-stearamide, and combinations thereof, wherein the total amount of binding agent (c), flow agent (d), and organic metal-free lubricant (e) is from 0.1 to 2 percent by weight of said metallurgical powder composition, and wherein said binding agent (c) is present in a concentration of 10 to 90 percent by weight based on the total weight of said binding agent (c), said flow agent (d), and said organic metal-free lubricant (e), mixing said above components at a temperature above the melting point of said binding agent (c); and cooling the mixture.

10. The powder composition according to claim 6, wherein the particle size of the carbon black is below 100 nm.

11. The powder composition according to claim 6, wherein the particle size of the carbon black is below 50 nm.

12. The powder composition according to claim 1, wherein said organic metal-free pulverulent lubricant is ethylene bis-stearamide.

* * * * *